US012320238B2

(12) United States Patent
Purcelean et al.

(10) Patent No.: US 12,320,238 B2
(45) Date of Patent: Jun. 3, 2025

(54) ENCAPSULATED SHAPED CHARGE

(71) Applicant: DynaEnergetics Europe GmbH, Troisdorf (DE)

(72) Inventors: Stefan Purcelean, Troisdorf (DE); Joern Olaf Loehken, Troisdorf (DE); Benjamin Donauer, Lohmar (DE); Joerg Mueller, Bonn-Lengsdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 18/258,598

(22) PCT Filed: May 21, 2021

(86) PCT No.: PCT/EP2021/063717

§ 371 (c)(1),
(2) Date: Jun. 21, 2023

(87) PCT Pub. No.: WO2022/135749

PCT Pub. Date: Jun. 30, 2022

(65) Prior Publication Data

US 2024/0376807 A1 Nov. 14, 2024

Related U.S. Application Data

(60) Provisional application No. 63/171,432, filed on Apr. 6, 2021, provisional application No. 63/128,401, filed on Dec. 21, 2020.

(51) Int. Cl.
*E21B 43/117* (2006.01)
*F42B 1/02* (2006.01)

(52) U.S. Cl.
CPC ..... *E21B 43/117* (2013.01); *F42B 1/02* (2013.01)

(58) Field of Classification Search
CPC ..... F42B 1/02; E21B 43/117
See application file for complete search history.

(56) References Cited

U.S. PATENT DOCUMENTS

| | | | |
|---|---|---|---|
| 214,754 | A | 4/1879 | Brock et al. |
| 1,757,288 | A | 5/1930 | Bleecker |

(Continued)

FOREIGN PATENT DOCUMENTS

| | | | |
|---|---|---|---|
| CA | 2196385 | A1 | 7/1998 |
| CA | 2933762 | C | 4/2020 |
| CN | 210598934 | U | 5/2020 |
| CN | 211115936 | U | 7/2020 |
| EP | 2282003 | A2 | 2/2011 |
| EP | 1682846 | B1 | 1/2014 |

(Continued)

OTHER PUBLICATIONS

Schlumberger; Exposed Perforating Gun Systems Through-tuning capsule gun systems; https://www.slb.com/completions/well-completions/perforating/perforating-gun-systems/exposed#related-information; Retrieved from web on Dec. 28. 2020; 2 pages.

(Continued)

*Primary Examiner* — Joshua E Freeman
(74) *Attorney, Agent, or Firm* — Womble Bond Dickinson (US) LLP

(57) ABSTRACT

Various exemplary embodiments of an encapsulated shaped charge (100) may include a charge case (110), a charge lid (120) covering an open end of the charge case, and an external clip assembly connected to each of the charge case and the charge lid. The charge case may house explosive material (111) and a shaped charge liner (112). The external clip assembly may include one or more clips (140) respectively connected to each of a retainer ring (130) positioned on the charge lid, and the charge case. The retainer ring may be formed from a material that will melt or burn when exposed to fire. According to the exemplary embodiments, melting or burning the retainer ring can release the one or more clips from the retainer ring and/or charge lid.

18 Claims, 12 Drawing Sheets

(56) References Cited

U.S. PATENT DOCUMENTS 2,062,974 A 12/1936 Lane
2,142,572 A 1/1939 Metzner
2,147,544 A 2/1939 Potts
2,228,873 A 1/1941 Hardt et al.
2,252,270 A 8/1941 Miller
2,296,346 A 9/1942 Hearn
2,308,004 A 1/1943 Hart
2,418,486 A 4/1947 Smylie
2,439,394 A 4/1948 Lanzalotti et al.
2,462,784 A 2/1949 Smith
2,550,004 A 4/1951 Doll
2,598,651 A 5/1952 Spencer
2,618,343 A 11/1952 Conrad
2,667,836 A 2/1954 Church et al.
2,681,114 A 6/1954 Conrad
2,687,092 A 8/1954 Duesing
2,695,064 A 11/1954 Ragan et al.
2,696,259 A 12/1954 Greene
2,713,909 A 7/1955 Baker
2,713,910 A 7/1955 Baker et al.
2,734,456 A 2/1956 Sweetman
2,755,863 A 7/1956 Stansbury et al.
2,756,958 A 7/1956 Binns et al.
2,765,739 A 10/1956 Mohaupt et al.
2,769,701 A 11/1956 Frederick
2,785,631 A 3/1957 Blanchard
2,815,816 A 12/1957 Baker
2,946,283 A 7/1960 Udry
2,979,904 A 4/1961 Royer
2,982,210 A 5/1961 Andrew et al.
3,013,491 A 12/1961 Poulter
3,024,843 A 3/1962 Dean
3,026,939 A 3/1962 Sweetman
3,031,964 A 5/1962 Chesnut
3,036,636 A 5/1962 Clark
3,055,430 A 9/1962 Campbell
3,076,507 A 2/1963 Sweetman
3,077,834 A 2/1963 Caldwell
3,094,166 A 6/1963 Mccullough
3,116,690 A 1/1964 Gillingham et al.
3,119,178 A 1/1964 Owen et al.
3,125,024 A 3/1964 Hicks et al.
3,140,537 A 7/1964 Popoff
3,143,068 A * 8/1964 Bell ..... E21B 43/117 102/310
3,154,632 A 10/1964 Browne
3,160,209 A 12/1964 Bonner
3,211,222 A 10/1965 Myers
3,220,480 A 11/1965 Myers
3,233,674 A 2/1966 Kurt
3,235,005 A 2/1966 Jacques
3,244,232 A 4/1966 Myers
3,264,994 A 8/1966 Kurt
3,266,575 A 8/1966 Owen
3,298,437 A 1/1967 Conrad
3,327,630 A 6/1967 Bell
3,357,355 A 12/1967 Roush
3,361,204 A 1/1968 Howard et al.
3,366,179 A 1/1968 Kinley et al.
3,398,803 A 8/1968 Kurt et al.
3,498,376 A 3/1970 Sizer et al.
3,589,453 A 6/1971 Venghiattis
3,630,284 A 12/1971 Fast et al.
3,659,658 A * 5/1972 Brieger ..... E21B 43/117 175/4.6
3,691,954 A 9/1972 Kern
3,712,376 A 1/1973 Young et al.
3,731,626 A 5/1973 Grayson
3,762,470 A 10/1973 Eggleston
3,777,663 A 12/1973 Brown
3,892,455 A 7/1975 Sotolongo
3,965,993 A * 6/1976 Lavigne ..... F42B 3/08 175/4.6
3,991,836 A * 11/1976 Bouguyon ..... F42B 3/08 102/306
4,003,433 A 1/1977 Goins
4,024,817 A 5/1977 Calder, Jr et al.
4,039,239 A 8/1977 Cobaugh et al.
4,063,512 A 12/1977 Davis
4,064,935 A 12/1977 Mohaupt
4,080,902 A 3/1978 Goddard et al.
4,099,464 A 7/1978 Cross et al.
4,107,453 A 8/1978 Erixon
4,109,576 A 8/1978 Eckels
4,132,171 A 1/1979 Pawlak et al.
4,172,421 A 10/1979 Regalbuto
4,191,265 A 3/1980 Bosse-Platiere
4,220,087 A 9/1980 Posson
4,250,960 A 2/1981 Chammas
4,269,120 A 5/1981 Brede et al.
4,273,047 A 6/1981 Rommer
4,290,486 A 9/1981 Regalbuto
4,312,273 A 1/1982 Camp
4,317,413 A 3/1982 Strandli et al.
4,319,526 A 3/1982 DerMott
4,346,954 A 8/1982 Appling
4,363,529 A 12/1982 Loose
4,387,773 A 6/1983 McPhee
4,429,741 A 2/1984 Hyland
4,455,941 A 6/1984 Walker et al.
4,485,741 A 12/1984 Moore et al.
4,496,008 A 1/1985 Pottier et al.
4,530,396 A 7/1985 Mohaupt
4,534,423 A 8/1985 Regalbuto
4,537,132 A 8/1985 Sabranski et al.
4,583,602 A 4/1986 Ayers
4,609,056 A 9/1986 Colle, Jr. et al.
4,609,057 A 9/1986 Walker et al.
4,617,997 A 10/1986 Jennings, Jr.
4,619,318 A 10/1986 Terrell et al.
4,619,333 A 10/1986 George
4,620,591 A 11/1986 Terrell et al.
4,784,061 A 11/1988 Christopher
4,817,531 A 4/1989 Walker et al.
4,875,413 A * 10/1989 Christopher ..... E21B 43/117 175/4.51
4,881,445 A 11/1989 Hayes
4,885,993 A 12/1989 Hancock et al.
5,088,557 A 2/1992 Ricles et al.
5,155,293 A 10/1992 Barton
5,248,055 A * 9/1993 Sanai ..... F42B 39/20 220/325
5,505,135 A 4/1996 Fritz et al.
5,792,977 A 8/1998 Chawla
6,098,707 A 8/2000 Pastusek et al.
6,216,596 B1 4/2001 Wesson
6,378,438 B1 4/2002 Lussier et al.
6,453,817 B1 9/2002 Markel et al.
6,520,258 B1 2/2003 Yang et al.
6,684,791 B1 2/2004 Barnhart
6,925,924 B2 8/2005 Baker et al.
7,237,486 B2 7/2007 Myers, Jr. et al.
7,762,351 B2 7/2010 Vidal
7,775,279 B2 8/2010 Marya et al.
7,987,911 B2 8/2011 Rhodes et al.
8,342,094 B2 1/2013 Marya et al.
8,544,563 B2 10/2013 Bourne et al.
9,671,201 B2 6/2017 Marya et al.
9,695,677 B2 7/2017 Moody-Stuart et al.
10,000,994 B1 6/2018 Sites
10,001,007 B2 6/2018 Pelletier et al.
10,036,236 B1 7/2018 Sullivan et al.
10,041,321 B2 8/2018 Oag et al.
10,047,591 B2 8/2018 Bell et al.
10,047,592 B2 8/2018 Burgos et al.
10,053,968 B2 8/2018 Tolman et al.
10,054,414 B2 8/2018 Scheid et al.
10,066,921 B2 9/2018 Eitschberger
10,077,626 B2 9/2018 Xu et al.
10,087,708 B2 10/2018 Al-Gouhi et al.
10,107,054 B2 10/2018 Drury et al.
10,138,713 B2 11/2018 Tolman et al.
10,151,152 B2 12/2018 Wight et al.
10,151,180 B2 12/2018 Robey et al.

(56) References Cited

U.S. PATENT DOCUMENTS 10,151,181 B2 12/2018 Lopez et al.
10,167,691 B2 1/2019 Zhang et al.
10,174,595 B2 1/2019 Knight et al.
10,180,050 B2 1/2019 Hardesty
10,184,327 B2 1/2019 Skyler
10,196,886 B2 2/2019 Tolman et al.
10,208,573 B2 2/2019 Kaenel et al.
10,240,441 B2 3/2019 Geerts et al.
10,246,952 B2 4/2019 Trydal et al.
10,267,127 B2 * 4/2019 Geerts ..... F42B 1/02
10,267,603 B2 4/2019 Marshall et al.
10,287,873 B2 5/2019 Filas et al.
10,301,910 B2 5/2019 Whitsitt et al.
10,321,594 B2 6/2019 Zhu et al.
10,323,484 B2 6/2019 Liess
10,337,270 B2 7/2019 Carisella et al.
10,337,301 B2 7/2019 Harive
10,358,880 B2 7/2019 Metcalf et al.
10,365,079 B2 7/2019 Harrington et al.
10,422,195 B2 9/2019 LaGrange et al.
10,428,595 B2 10/2019 Bradley et al.
10,429,161 B2 10/2019 Parks et al.
10,458,213 B1 10/2019 Eitschberger et al.
10,465,488 B2 11/2019 Collins et al.
10,472,901 B2 11/2019 Engel et al.
10,472,938 B2 11/2019 Parks et al.
10,488,163 B2 11/2019 Collins et al.
10,584,565 B2 3/2020 Golian et al.
10,605,018 B2 3/2020 Schmidt et al.
10,669,822 B2 6/2020 Eitschberger
10,677,026 B2 6/2020 Sokolove et al.
10,683,735 B1 6/2020 McCarthy et al.
10,731,443 B2 8/2020 Kaenel et al.
10,739,115 B2 8/2020 Loehken et al.
10,954,760 B2 * 3/2021 McNelis ..... E21B 43/1185
11,053,782 B2 7/2021 Loehken et al.
11,339,632 B2 5/2022 Eitschberger et al.
2001/0052303 A1 12/2001 Mayseless et al.
2002/0017214 A1 2/2002 Jacoby et al.
2002/0036101 A1 3/2002 Huhdanmaki et al.
2002/0040783 A1 4/2002 Zimmerman et al.
2002/0129940 A1 9/2002 Yang et al.
2002/0129941 A1 9/2002 Alves et al.
2002/0134552 A1 9/2002 Moss
2002/0189482 A1 12/2002 Kneisl et al.
2003/0001753 A1 1/2003 Cernocky et al.
2003/0155112 A1 8/2003 Tiernan et al.
2003/0183113 A1 10/2003 Barlow et al.
2004/0094305 A1 5/2004 Skjærseth et al.
2004/0141279 A1 7/2004 Amano et al.
2004/0211862 A1 10/2004 Elam
2004/0216632 A1 11/2004 Finsterwald
2004/0239521 A1 12/2004 Zierolf
2005/0011645 A1 1/2005 Aronstam et al.
2005/0103526 A1 5/2005 Ayling
2005/0115448 A1 6/2005 Pratt et al.
2005/0183610 A1 8/2005 Barton et al.
2005/0186823 A1 8/2005 Ring et al.
2005/0194146 A1 9/2005 Barker et al.
2005/0217844 A1 10/2005 Edwards et al.
2005/0218260 A1 10/2005 Corder et al.
2005/0229805 A1 10/2005 Myers, Jr. et al.
2005/0257710 A1 11/2005 Monetti et al.
2005/0269083 A1 12/2005 Burris, II et al.
2006/0013282 A1 1/2006 Hanzawa et al.
2006/0054326 A1 3/2006 Alves et al.
2006/0075890 A1 4/2006 Tiernan
2006/0081374 A1 4/2006 Bland et al.
2006/0082152 A1 4/2006 Neves
2007/0079966 A1 4/2007 George et al.
2007/0084336 A1 4/2007 Neves
2007/0125540 A1 6/2007 Gerez et al.
2007/0158071 A1 7/2007 Mooney et al.
2007/0267195 A1 11/2007 Grigar et al.
2008/0047456 A1 2/2008 Li et al.
2008/0047716 A1 2/2008 McKee et al.
2008/0110612 A1 5/2008 Prinz et al.
2008/0110632 A1 5/2008 Beall
2008/0121095 A1 5/2008 Han et al.
2008/0134922 A1 6/2008 Grattan et al.
2008/0223587 A1 9/2008 Cherewyk
2008/0264639 A1 10/2008 Parrott et al.
2009/0050321 A1 2/2009 Rhodes et al.
2009/0151949 A1 6/2009 Marya et al.
2009/0159283 A1 6/2009 Fuller et al.
2009/0159285 A1 6/2009 Goodman
2009/0183916 A1 7/2009 Pratt et al.
2009/0211760 A1 8/2009 Richards et al.
2009/0255728 A1 10/2009 Spencer et al.
2009/0272519 A1 11/2009 Green et al.
2009/0301723 A1 12/2009 Gray
2009/0308589 A1 12/2009 Bruins et al.
2010/0000789 A1 1/2010 Barton et al.
2010/0012774 A1 1/2010 Fanucci et al.
2010/0022125 A1 1/2010 Burris et al.
2010/0024674 A1 2/2010 Peeters et al.
2010/0089643 A1 4/2010 Vidal
2010/0096131 A1 4/2010 Hill et al.
2010/0107917 A1 5/2010 Moser
2010/0163224 A1 7/2010 Strickland
2010/0230104 A1 9/2010 Nölke et al.
2010/0288496 A1 11/2010 Cherewyk
2010/0307773 A1 12/2010 Tinnen et al.
2011/0005777 A1 1/2011 Meff
2011/0024116 A1 2/2011 McCann et al.
2011/0042069 A1 2/2011 Bailey et al.
2011/0094406 A1 4/2011 Marya et al.
2011/0155013 A1 6/2011 Boyer et al.
2011/0209871 A1 9/2011 Le et al.
2011/0301784 A1 12/2011 Oakley et al.
2012/0006217 A1 1/2012 Anderson
2012/0085538 A1 4/2012 Guerrero et al.
2012/0094553 A1 4/2012 Fujiwara et al.
2012/0152542 A1 6/2012 Le
2012/0160483 A1 6/2012 Carisella
2012/0160491 A1 6/2012 Goodman et al.
2012/0180678 A1 7/2012 Kneisl
2012/0199031 A1 8/2012 Lanclos
2012/0241169 A1 9/2012 Hales et al.
2012/0242135 A1 9/2012 Thomson et al.
2012/0247771 A1 10/2012 Black et al.
2013/0008639 A1 1/2013 Tassaroli et al.
2013/0043074 A1 2/2013 Tassaroli
2013/0048376 A1 2/2013 Rodgers et al.
2013/0056208 A1 3/2013 Xu
2013/0062055 A1 3/2013 Tolman et al.
2013/0118342 A1 5/2013 Tassaroli
2013/0118805 A1 5/2013 Moody-Stuart et al.
2013/0168083 A1 7/2013 McCarter et al.
2013/0199843 A1 8/2013 Ross
2013/0228326 A1 9/2013 Griffith et al.
2013/0248174 A1 9/2013 Dale et al.
2013/0256464 A1 10/2013 Belik et al.
2013/0327571 A1 12/2013 Andrzejak
2014/0000877 A1 1/2014 Robertson et al.
2014/0026776 A1 1/2014 Kecskes et al.
2014/0033939 A1 2/2014 Priess et al.
2014/0053750 A1 2/2014 Lownds et al.
2014/0060839 A1 3/2014 Wang et al.
2014/0061376 A1 3/2014 Fisher et al.
2014/0083774 A1 3/2014 Hoult et al.
2014/0127941 A1 5/2014 Lu
2014/0131035 A1 5/2014 Entchev et al.
2014/0138090 A1 5/2014 Hill et al.
2014/0148044 A1 5/2014 Balcer et al.
2014/0166370 A1 6/2014 Silva
2014/0209381 A1 7/2014 Huang et al.
2014/0218207 A1 8/2014 Gano et al.
2014/0314977 A1 10/2014 Weinhold
2014/0360720 A1 12/2014 Corbeil
2015/0041124 A1 2/2015 Rodriguez
2015/0114626 A1 4/2015 Hatten et al.
2015/0167410 A1 6/2015 Garber et al.
2015/0176386 A1 6/2015 Castillo et al.

(56) References Cited

U.S. PATENT DOCUMENTS

2015/0209954 A1 7/2015 Hokanson
2015/0226533 A1 8/2015 Grattan
2015/0247375 A1 9/2015 Stout
2015/0275615 A1 10/2015 Rytlewski et al.
2015/0316360 A1 11/2015 Hinton et al.
2015/0354310 A1 12/2015 Zaiser
2015/0356403 A1 12/2015 Storm, Jr.
2015/0361774 A1 12/2015 Flores
2015/0376991 A1 12/2015 Mcnelis et al.
2016/0040502 A1 2/2016 Robben
2016/0040520 A1 2/2016 Tolman et al.
2016/0053560 A1 2/2016 Drury et al.
2016/0069163 A1 3/2016 Tolman et al.
2016/0084048 A1 3/2016 Harrigan et al.
2016/0108722 A1 4/2016 Whitsitt et al.
2016/0115741 A1 4/2016 Davis
2016/0144734 A1 5/2016 Wang et al.
2016/0145990 A1 5/2016 Mace et al.
2016/0153267 A1 6/2016 Walker et al.
2016/0153271 A1 6/2016 Mace et al.
2016/0153272 A1 6/2016 Mace et al.
2016/0168961 A1 6/2016 Parks et al.
2016/0186511 A1 6/2016 Coronado et al.
2016/0186513 A1 6/2016 Robertson et al.
2016/0202027 A1 7/2016 Peterson et al.
2016/0215592 A1 7/2016 Helms et al.
2016/0223171 A1 8/2016 Gibbons et al.
2016/0258240 A1 9/2016 Fripp et al.
2016/0290084 A1 10/2016 LaGrange et al.
2016/0290098 A1 10/2016 Marya
2016/0298404 A1 10/2016 Beckett et al.
2016/0356132 A1 12/2016 Burmeister et al.
2017/0009559 A1 1/2017 Spring
2017/0030162 A1 2/2017 Carragher
2017/0030693 A1 2/2017 Preiss et al.
2017/0032653 A1 2/2017 Crawford et al.
2017/0037716 A1 2/2017 Kohlik
2017/0044865 A1 2/2017 Sabins et al.
2017/0044875 A1 2/2017 Hebebrand et al.
2017/0052004 A1 2/2017 Xue
2017/0052011 A1 2/2017 Parks et al.
2017/0058648 A1 3/2017 Geerts et al.
2017/0058649 A1 3/2017 Geerts et al.
2017/0067303 A1 3/2017 Thiemann et al.
2017/0067320 A1 3/2017 Zouhair et al.
2017/0074078 A1 3/2017 Eitschberger
2017/0138150 A1 5/2017 Yencho
2017/0159379 A1 6/2017 Metcalf et al.
2017/0167233 A1 6/2017 Sampson et al.
2017/0175488 A1 6/2017 Lisowski et al.
2017/0175500 A1 6/2017 Robey et al.
2017/0199015 A1 7/2017 Collins et al.
2017/0204687 A1 7/2017 Yorga et al.
2017/0226814 A1 8/2017 Clemens et al.
2017/0241244 A1 8/2017 Barker et al.
2017/0268320 A1 9/2017 Angman et al.
2017/0268326 A1 9/2017 Tao et al.
2017/0268860 A1 9/2017 Eitschberger
2017/0275976 A1 9/2017 Collins et al.
2017/0276465 A1 9/2017 Parks et al.
2017/0298716 A1 10/2017 McConnell et al.
2017/0306710 A1 10/2017 Trydal et al.
2017/0314372 A1 11/2017 Tolman et al.
2017/0314373 A9 11/2017 Bradley et al.
2017/0328134 A1 11/2017 Sampson et al.
2017/0328160 A1 11/2017 Arnaly
2017/0335646 A1 11/2017 Huang et al.
2017/0357021 A1 12/2017 Valero et al.
2018/0002999 A1 1/2018 Johnson
2018/0003038 A1 1/2018 Cherewyk
2018/0003045 A1 1/2018 Dotson et al.
2018/0030334 A1 2/2018 Collier et al.
2018/0038208 A1 2/2018 Eitschberger et al.
2018/0080298 A1 3/2018 Covalt et al.
2018/0080300 A1 3/2018 Angstmann et al.
2018/0087330 A1 3/2018 Bradley et al.
2018/0087369 A1 3/2018 Sherman et al.
2018/0106121 A1 4/2018 Griffin et al.
2018/0119529 A1 5/2018 Goyeneche
2018/0120066 A1 5/2018 Khatiwada et al.
2018/0127641 A1 5/2018 Nguyen et al.
2018/0135398 A1 5/2018 Entchev et al.
2018/0148995 A1 5/2018 Burky et al.
2018/0156029 A1 6/2018 Harrison et al.
2018/0163497 A1 6/2018 Younger
2018/0171757 A1 6/2018 Xu
2018/0202248 A1 7/2018 Harrington et al.
2018/0202249 A1 7/2018 Harrington et al.
2018/0202789 A1 7/2018 Parks et al.
2018/0202790 A1 7/2018 Parks et al.
2018/0209250 A1 7/2018 Daly et al.
2018/0209251 A1 7/2018 Robey et al.
2018/0238132 A1 8/2018 Oag et al.
2018/0252054 A1 9/2018 Stokes
2018/0252507 A1 9/2018 Collier
2018/0274356 A1 9/2018 Hazel
2018/0283836 A1 10/2018 Thomas
2018/0291715 A1 10/2018 Barker
2018/0299239 A1 10/2018 Eitschberger et al.
2018/0305993 A1 10/2018 Perkins et al.
2018/0306010 A1 10/2018 Von Kaenel et al.
2018/0313182 A1 11/2018 Cherewyk et al.
2018/0318770 A1 11/2018 Eitschberger et al.
2018/0340412 A1 11/2018 Singh et al.
2018/0347324 A1 12/2018 Langford et al.
2018/0355674 A1 12/2018 Cooper et al.
2018/0363424 A1 12/2018 Schroeder et al.
2019/0031307 A1 1/2019 Siersdorfer
2019/0032470 A1 1/2019 Harrigan
2019/0040722 A1 2/2019 Yang et al.
2019/0048693 A1 2/2019 Henke et al.
2019/0049225 A1 2/2019 Eitschberger
2019/0085664 A1 3/2019 Hardesty et al.
2019/0085685 A1 3/2019 McBride
2019/0106962 A1 4/2019 Lee et al.
2019/0128657 A1 5/2019 Harrington et al.
2019/0136673 A1 5/2019 Sullivan et al.
2019/0153827 A1 5/2019 Goyeneche
2019/0162055 A1 5/2019 Collins et al.
2019/0162056 A1 5/2019 Sansing
2019/0162057 A1 5/2019 Montoya Ashton et al.
2019/0186211 A1 6/2019 Gonzalez
2019/0195054 A1 6/2019 Bradley et al.
2019/0211655 A1 7/2019 Bradley et al.
2019/0218880 A1 7/2019 Cannon et al.
2019/0219375 A1 7/2019 Parks et al.
2019/0234188 A1 8/2019 Goyeneche
2019/0242222 A1 8/2019 Eitschberger
2019/0257158 A1 8/2019 Langford et al.
2019/0257181 A1 8/2019 Langford et al.
2019/0264548 A1 8/2019 Zhao et al.
2019/0277103 A1 9/2019 Wells et al.
2019/0284889 A1 9/2019 LaGrange et al.
2019/0292887 A1 9/2019 Austin et al.
2019/0316449 A1 10/2019 Schultz et al.
2019/0330947 A1 10/2019 Mulhern et al.
2019/0330961 A1 10/2019 Knight et al.
2019/0338606 A1 11/2019 Metcalf et al.
2019/0338612 A1 11/2019 Holodnak et al.
2019/0353015 A1 11/2019 LaGrange et al.
2019/0366272 A1 12/2019 Eitschberger et al.
2019/0368293 A1 12/2019 Covalt et al.
2019/0368301 A1 12/2019 Eitschberger et al.
2019/0368318 A1* 12/2019 Loehken ..... E21B 43/117
2019/0368319 A1 12/2019 Collins et al.
2019/0368331 A1 12/2019 Vick, Jr. et al.
2020/0018132 A1 1/2020 Ham
2020/0024934 A1 1/2020 Eitschberger et al.
2020/0024935 A1 1/2020 Eitschberger et al.
2020/0032626 A1 1/2020 Parks et al.
2020/0048996 A1 2/2020 Anthony et al.
2020/0063537 A1 2/2020 Langford et al.
2020/0063553 A1 2/2020 Zemla et al.
2020/0072029 A1 3/2020 Anthony et al.

(56) References Cited

U.S. PATENT DOCUMENTS

| | | | | |
|---|---|---|---|---|
| 2020/0088011 | A1 | 3/2020 | Eitschberger et al. | |
| 2020/0095838 | A1 | 3/2020 | Baker | |
| 2020/0182025 | A1 | 6/2020 | Brady | |
| 2020/0217635 | A1 | 7/2020 | Eitschberger | |
| 2020/0248535 | A1 | 8/2020 | Goyeneche | |
| 2020/0248536 | A1 | 8/2020 | Holodnak et al. | |
| 2020/0256166 | A1 | 8/2020 | Knight et al. | |
| 2020/0256168 | A1 | 8/2020 | Knight et al. | |
| 2020/0284104 | A1 | 9/2020 | Holmberg et al. | |
| 2020/0300067 | A1* | 9/2020 | McNelis | F42B 3/24 |
| 2021/0238966 | A1 | 8/2021 | Preiss et al. | |

FOREIGN PATENT DOCUMENTS

| | | | |
|---|---|---|---|
| GB | 916870 | A | 1/1963 |
| WO | 2001004452 | A1 | 1/2001 |
| WO | 2005103602 | A2 | 11/2005 |
| WO | 2009117548 | A1 | 9/2009 |
| WO | 2016161376 | A1 | 10/2016 |
| WO | 2017029240 | A1 | 2/2017 |
| WO | 2018177733 | A1 | 10/2018 |
| WO | 2018231847 | A1 | 12/2018 |
| WO | 2019105721 | A1 | 6/2019 |
| WO | 2019117874 | A1 | 6/2019 |
| WO | 2020150232 | A1 | 7/2020 |

OTHER PUBLICATIONS

DMC, Boom Times, Winter 2016 Brochure, DynaSlot System Successfully Deployed in a Variety of Applications Around the Globe, Issue 9, Sep. 16, 2016, 3 pages.

International Searching Authority, International Search Report and Written Opinion of International App. No. PCT/EP2018/080831, dated Feb. 15, 2019, 16 pgs.

USPTO, Notice of Allowance for U.S. Appl. No. 16/760,955, mailed Dec. 9, 2020, 9 pgs.

USPTO, Office Action of U.S. Appl. No. 16/760,955, dated Aug. 21, 2020, 14 pgs.

China National Intellectual Property Administration; Office Action for CN Application No. 201880088147.7; dated Feb. 25, 2022, 12 pages.

International Searching Authority; International Search Report and Written Opinion of the International Searching Authority for PCT/EP2021/063761; mailed on Nov. 24, 2021; 18 pages.

International Searching Authority; International Search Report and Written Opinion of the International Searching Authority for PCT/EP2021/084619; mailed on Sep. 22, 2021; 13 pages.

U.S. Department of Transportation; Classification of Explosives Fourth Revision; dated Jan. 31, 2014; 52 pages.

U.S. Appl. No. 16/287,150, filed Feb. 27, 2019, Frank Haron Preiss.

Dynaenergetics, Dynaslot System 360° Certainty Well Abandonment, Product Brochure, 6 pgs., https://www.dynaenergetics.com/en/products/hardware-and-tcp/perforating-gun-systems/dynaslot-gun-system.

Schlumberger; PowerSprial Nova Extradeep spiral-phased capsule gun perforating system Press Release; dated Oct. 22, 2020; Retrieved from web on Jan. 18, 2021; https://www.slb.com/completions/well-completions/Perforating/perforating-guns-and-charges/powerspiral-nova-capsule-gun-perforating-system; 2 pages.

U.S. Appl. No. 29/722,460, filed Jan. 30, 2020, Christian Eitschberger.

U.S. Appl. No. 29/722,461, filed Jan. 30, 2020, Christian Eitschberger.

U.S. Appl. No. 29/748,612, filed Aug. 31, 2020, Christian Eitschberger.

* cited by examiner

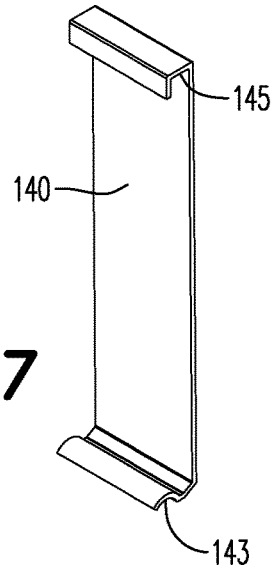
FIG. 7
FIG. 9
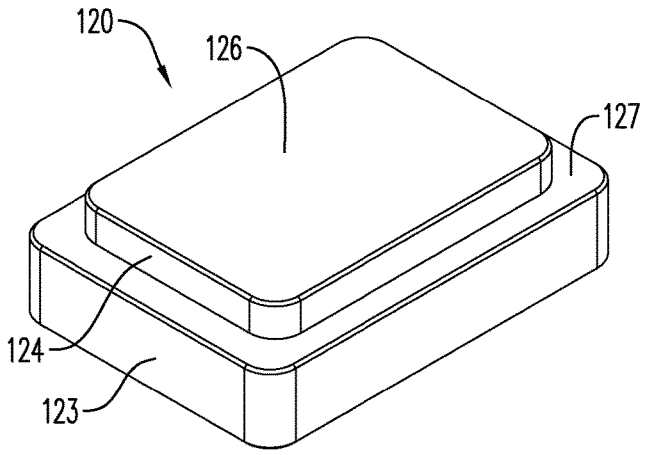
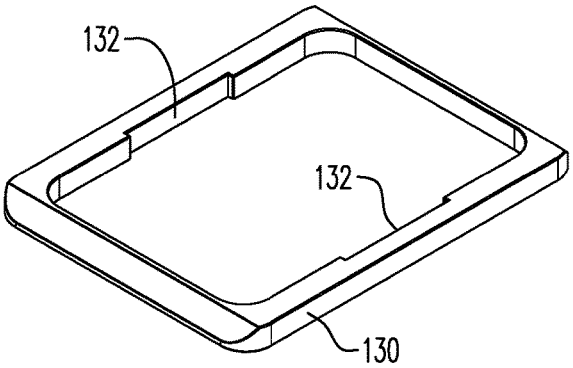
FIG. 8
FIG. 10A
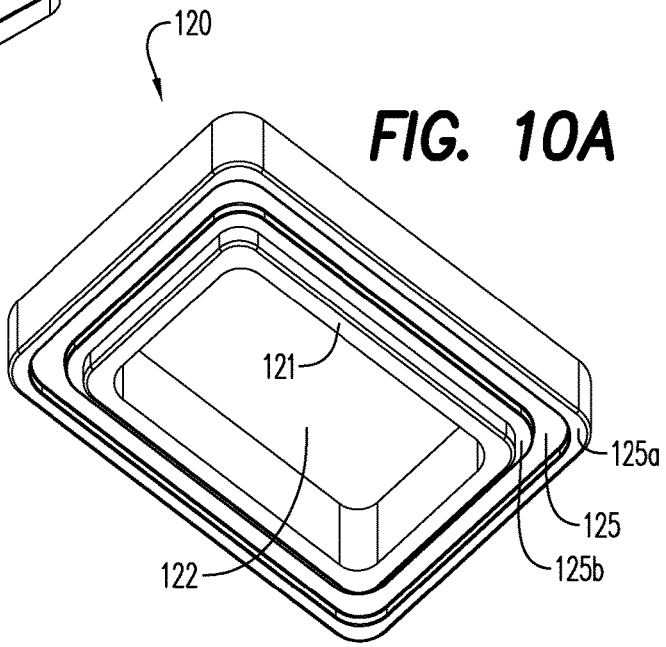

ENCAPSULATED SHAPED CHARGE

CROSS-REFERENCE TO RELATED APPLICATIONS

This application is a 371 of International Application No. PCT/EP2021/063717, filed May 21, 2021, which claims the benefit of priority to U.S. Provisional Application No. 63/171,432, filed Apr. 6, 2021, and U.S. Provisional Application No. 63/128,401, filed Dec. 21, 2020. The entire contents of each application is hereby incorporated by reference.

BACKGROUND OF THE DISCLOSURE

Oil and gas well completion processes include perforating a hydrocarbon formation to liberate the oil and gas within reservoirs therein. Hydrocarbon formations may include, for example, subterranean oil and gas shale formations, sandstone formations, and/or carbonate formations. Perforating guns perform the perforating operations. The perforating guns carry explosive charges, i.e., "shaped charges", into a wellbore that has been drilled into the hydrocarbon formation. The shaped charges detonate and an explosive jet formed by each shaped charge may perforate one or more of a structure surrounding the shaped charge or perforating gun within the wellbore, a layer of cement surrounding the wellbore, and the hydrocarbon formation. For example, the wellbore may include cemented-in casing pipes and other tubulars (collectively, "wellbore casing") that isolate an environment within the wellbore from the hydrocarbon formation prior to perforating. For brevity within this disclosure, the term "wellbore" refers to the drilled wellbore and any wellbore casing therein, except where otherwise specified.

The shape and configuration of the shaped charge and resulting explosive jet may vary depending on operational requirements. For example, abandonment procedures for decommissioned wells include permanently sealing the wellbore using cement. Unwanted vertical channels or voids may exist in a previously cemented wellbore annulus between the wellbore casing and the hydrocarbon formation may produce migration pathways for fluids or gas to contaminate surrounding areas. A "cement squeeze" operation uses perforating guns to perforate through the wellbore casing, but not necessarily into the hydrocarbon formation, to access the wellbore annulus via perforations through which cement is squeezed, under pressure, into the wellbore annulus. A goal for cement squeeze operations is for perforations to provide 360-degree access from within the wellbore casing to the wellbore annulus, to increase the coverage of cement in the annulus. Accordingly, a conventional perforating gun for a cement squeeze operation may include a helical arrangement of overlapping "slotted" shaped charges (FIG. 20) that are rectangularly-shaped and produce rectangularly-shaped perforations. The rectangular shape allows the long portions of the rectangular perforations to overlap and thereby provide 360-degree access.

The wellbore casing may also be a conduit for a wellbore fluid that is pumped into the wellbore casing to "pump down" perforating guns and reduce the time required for the perforating guns to reach their positions. The shaped charges must be sealed and protected against the wellbore fluids and hydraulic pressures within the wellbore. For example, in a typical "gun carrier"-type perforating gun, the shaped charges are retained and oriented in a charge carrier, such as a metal tube, housed with other perforating gun components within a sealed interior chamber of, e.g., a cylindrical gun housing such as a metal tube. Components within the sealed interior chamber need not be individually protected, but the shaped charge explosive jets must penetrate the gun housing in addition to, e.g., the wellbore casing. Alternatively, a typical "exposed" perforating gun includes shaped charges retained and oriented in a charge carrier that is exposed to the wellbore environment. The shaped charges must be individually protected against the wellbore environment, but the explosive jets need not first penetrate a gun housing, nor is the extra material, weight, machining, or cost a gun housing required. The shaped charges are typically protected by, among other things, sealing the interior of the shaped charges, including the explosive components, with a charge lid that covers and seal an open end of the shaped charge. The charge lid protects the components during normal use, but the sealed interior may present safety risks if, for example, the sealed charge is exposed to fire and the heat therefrom causes a buildup of gas pressure from the explosive within.

For at least the above reasons, a need exists for an encapsulated shaped charge that provides both a strong seal for the charge and safety.

BRIEF DESCRIPTION OF THE EXEMPLARY EMBODIMENTS

In an aspect, the disclosure relates to an encapsulated shaped charge. The encapsulated shaped charge may include a charge case and a charge lid. The charge case may hold an explosive and a liner. The charge lid may cover an open end of the charge case. The encapsulated shaped charge may further include an external clip assembly connected to each of the charge case and the charge lid.

In an aspect, the disclosure relates to an exposed perforating gun system. The exposed perforating gun system may include a charge carrier retaining a plurality of encapsulated shaped charges. Each shaped charge may include a charge case holding an explosive and a liner, a charge lid covering an open end of the charge case, and an external clip assembly. The external clip assembly may be connected to each of the charge case and the charge lid.

In an aspect, the disclosure relates to a method for reducing a buildup of gas pressure in an encapsulated shaped charge exposed to fire. The method may include enclosing an explosive within a charge case by, e.g., positioning a charge lid on an open end of the charge case within which the explosive is contained. The method may further include releasably connecting the charge lid to the charge case. Releasably connecting the charge lid to the charge case may include positioning a retainer ring on the charge lid and connecting a first end of a clip to the retainer ring and a second end of the clip to a bottom surface of the charge case. The retainer ring may be configured to melt or burn in response to exposure to fire. The method may further include releasing the clip from encapsulated shaped charge, in response to the retainer ring melting or burning in response to exposure to fire.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which:

FIG. 7 shows a clip, according to an exemplary embodiment;

FIG. 8 shows a retainer ring, according to an exemplary embodiment;

FIG. 9 is a top perspective view of a charge lid, according to an exemplary embodiment;

FIG. 10A is a bottom perspective view of a charge lid, according to an exemplary embodiment;

Figure 1:
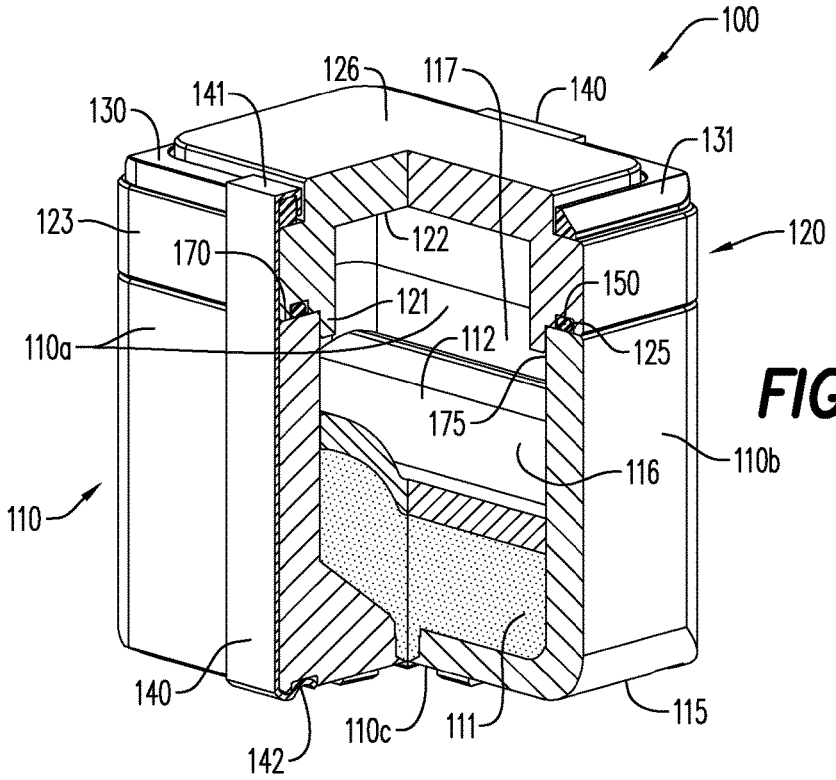
FIG. 1 is a partial cross-sectional view of an encapsulated shaped charge, according to an exemplary embodiment.
Figure 2A:
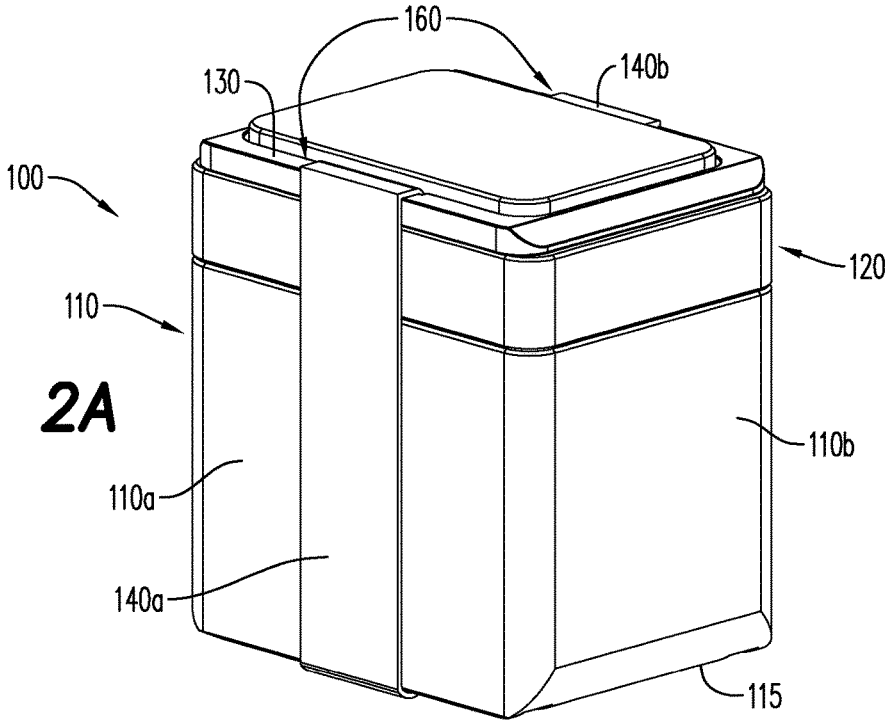
FIG. 2A is a perspective view of an encapsulated shaped charge, according to an exemplary embodiment.
Figure 2B:
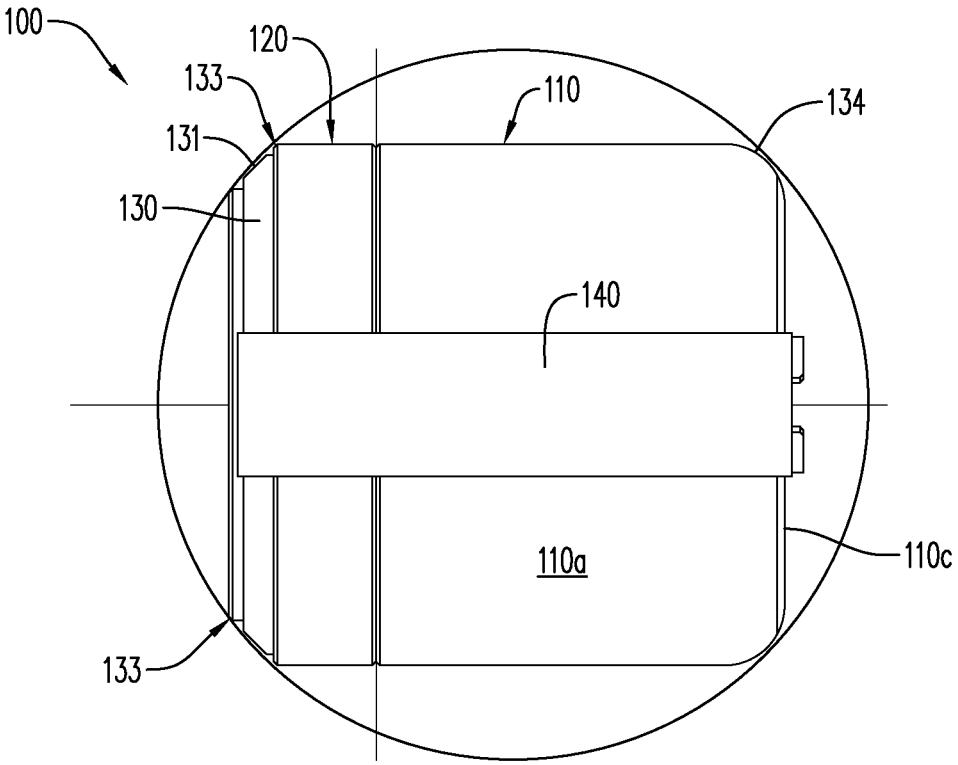
FIG. 2B is a front view of an encapsulated shaped charge, according to an exemplary embodiment, rotated 90-degrees.
Figure 3:
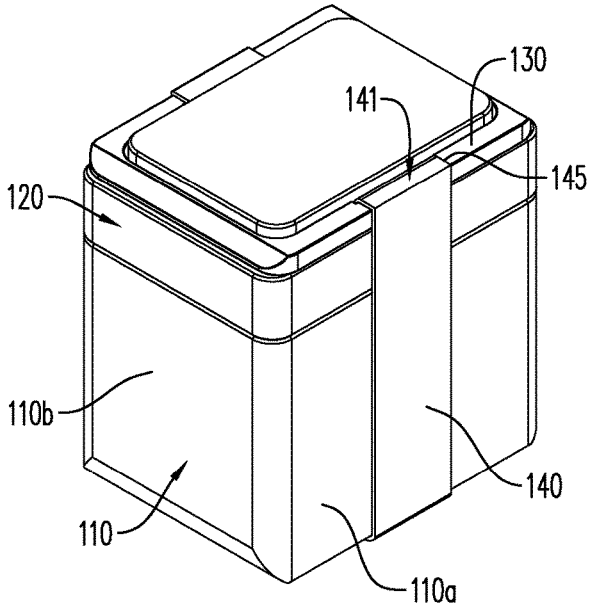
FIG. 3 is a top perspective view of the encapsulated shaped charge of FIG. 1, according to an exemplary embodiment.
Figure 4:
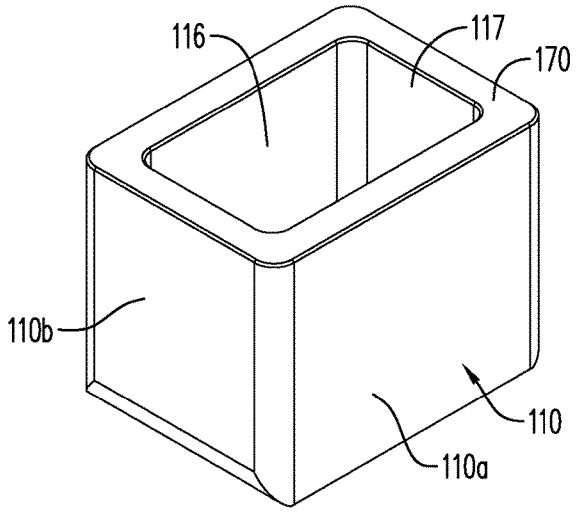
FIG. 4 is a top perspective view of a charge case, according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each of the exemplary embodiments is illustrative, provided by way of explanation, and not limiting. The exemplary embodiments do not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

For purposes of this disclosure, the phrases "devices," "systems," and "methods" may be used either individually or in any combination referring without limitation to disclosed components, grouping, arrangements, steps, functions, or processes.

Figure 20:
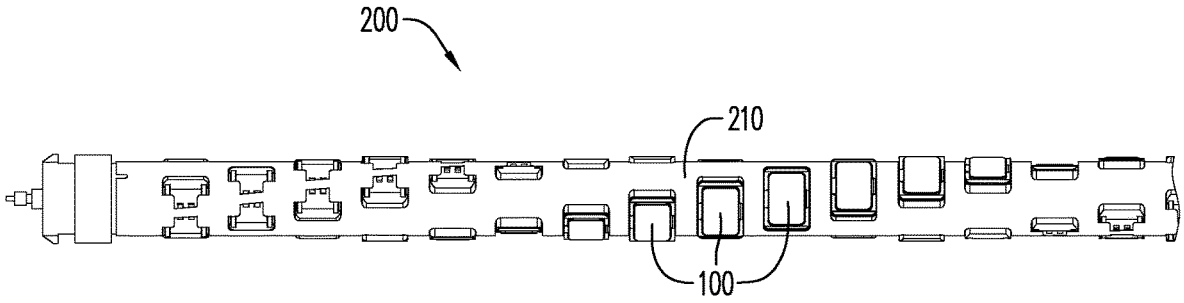
FIG. 20 shows an exposed perforating gun system, according to an exemplary embodiment.
Figure 21:
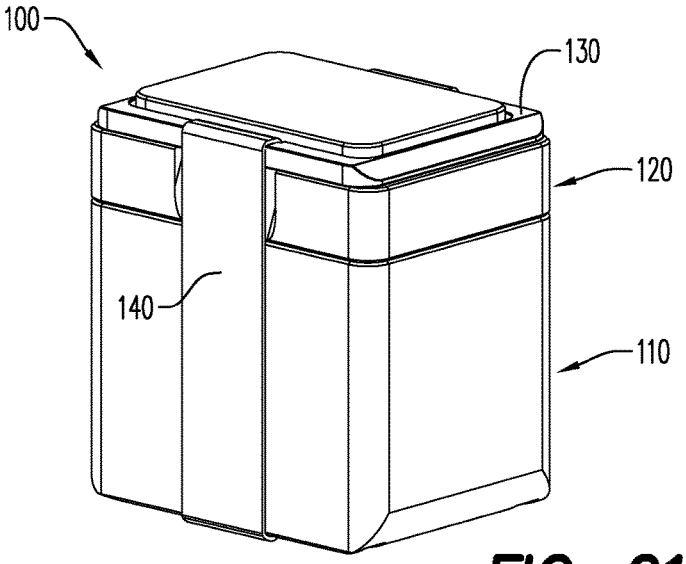
FIG. 21 is a front, top perspective view of an encapsulated shaped charge, according to an exemplary embodiment.
Figure 22:
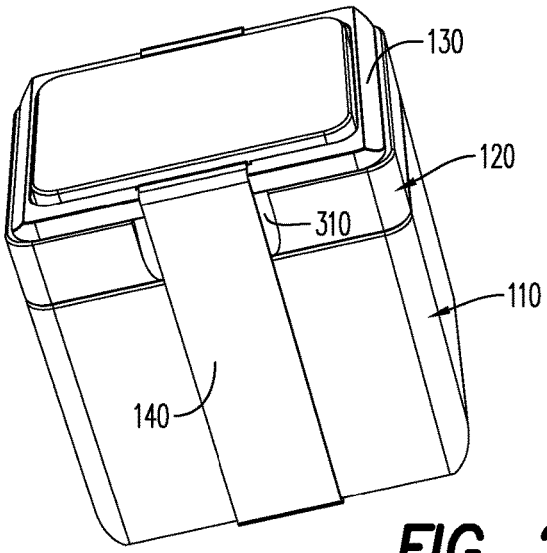
FIG. 22 is a top perspective view of the encapsulated shaped charge of FIG. 21, according to an exemplary embodiment.

With reference to FIGS. 1-6, the exemplary embodiments relate to an encapsulated shaped charge 100 for use in, without limitation, an exposed perforating gun system 200 (FIG. 20). The exemplary encapsulated shaped charge 100 shown in FIGS. 1-6 is a slotted shaped charge. In other words, it is generally rectangularly shaped. The exemplary encapsulated shaped charge includes a charge case 110 holding an explosive 111 and a liner 112 as are known for shaped charges. The charge case 110 includes a base wall 110*c*, opposing face walls 110*a* in a spaced apart relationship, and opposing side walls 110*b* in a spaced apart relationship. Each of the face walls 110*a* and the side walls 110*b* extends upwardly from the base wall 110*c*. Each of the side walls 110*b* extends from one of the face walls 110*a* to the opposing face wall 110*a*. The base wall 110*c*, opposing face walls 110*a*, and side walls 110*b* together define a charge case interior 116. The explosive 111 and the liner 112 are positioned within the charge case interior 116.

Figure 11:
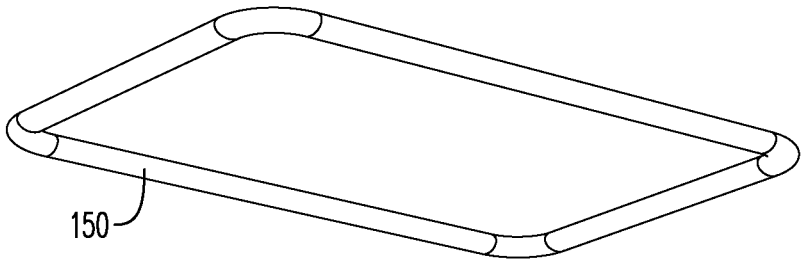
FIG. 11 shows an o-ring seal, according to an exemplary embodiment.

A charge lid 120 covers and seals an open end 117 opposite the base wall 110*c* of the charge case 110 (thereby making the shaped charge "encapsulated"). The charge lid 120 seals the encapsulated shaped charge 100 with, for example, an o-ring 150 (FIG. 11) positioned between the charge lid 120 and the charge case 110 and fixed within a channel 125 formed in the charge lid 120. The o-ring 150 may be in sealing contact with the charge lid 120, i.e., the channel 125, and the charge case 110. An inner skirt 121 extends downward from an inside portion 122 of the charge lid 120, such that the inner skirt 121 extends through the open end 117 of the charge case 110 and is adjacent a portion of the charge case 110 at the open end 117. The inner skirt 121 may provide additional stability of the charge lid 120 in position above the open end 117.

The exemplary embodiment shown in FIGS. 1-3 and 5 further includes a fastening assembly 160 for holding the charge lid 120 on the charge case 110. In the exemplary embodiments, but not limited thereto, the fastening assembly 160 includes a retainer ring 130 extending around a peripheral shoulder 127 (FIG. 9) of the charge lid 120 and opposing clips 140 on opposite sides of the encapsulated shaped charge 100. The opposing clips 140, individually or together, form an external clip assembly. In other words, for purposes of this disclosure, "external clip assembly" may refer to one or more clips 140 configured on an exterior of the charge case 110 and/or the charge lid 120. For example, with reference to FIG. 2A and without limitation, the external clip assembly according to an exemplary embodiment includes a first clip 140*a* on one face wall 110*a* of the charge case 110 and a second clip 140*b* on the opposing face wall 110*a*.

Figure 5:
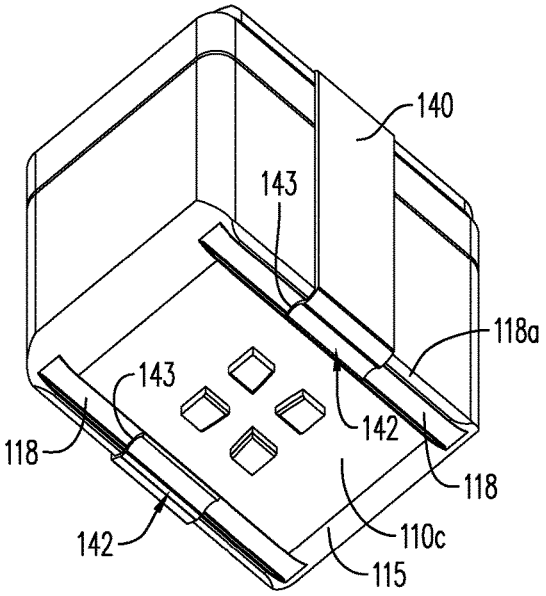
FIG. 5 is a bottom perspective view of the encapsulated shaped charge of FIG. 1, according to an exemplary embodiment.
Figure 6:
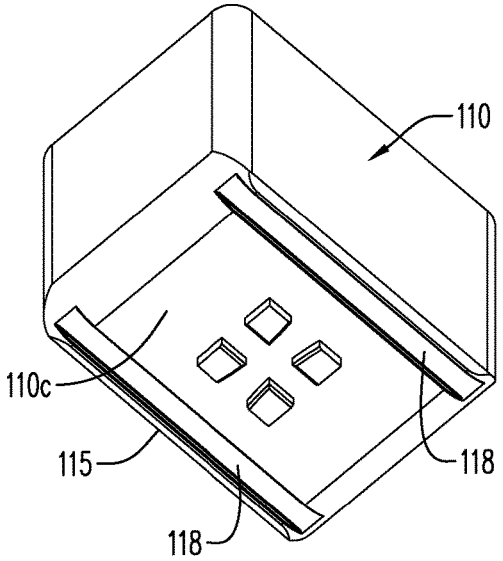
FIG. 6 is a bottom perspective view of a charge case, according to an exemplary embodiment.
Figure 14:
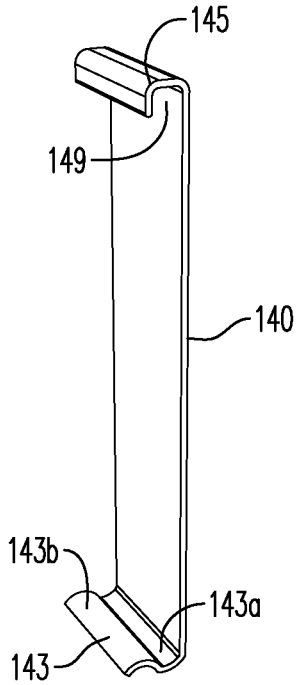
FIG. 14 is an enlarged view of the clip shown in FIG. 7, according to an exemplary embodiment.
Figure 15:
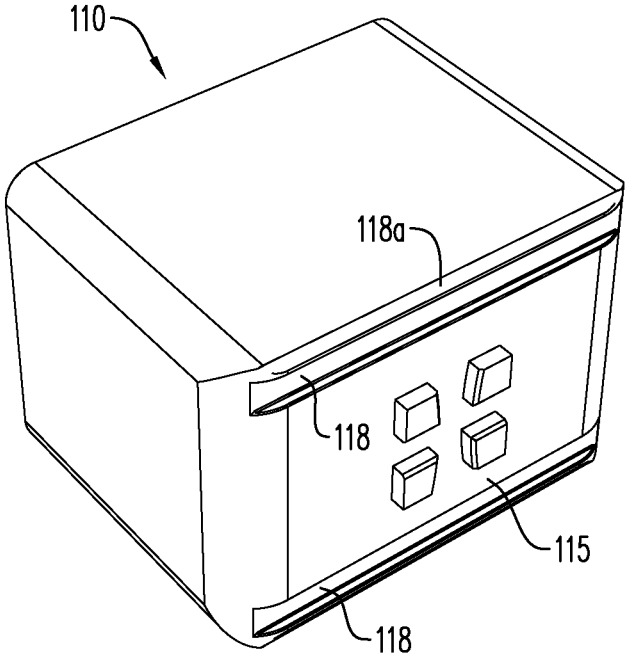
FIG. 15 is a front, bottom perspective view of a charge case, according to an exemplary embodiment.
Figure 16A:
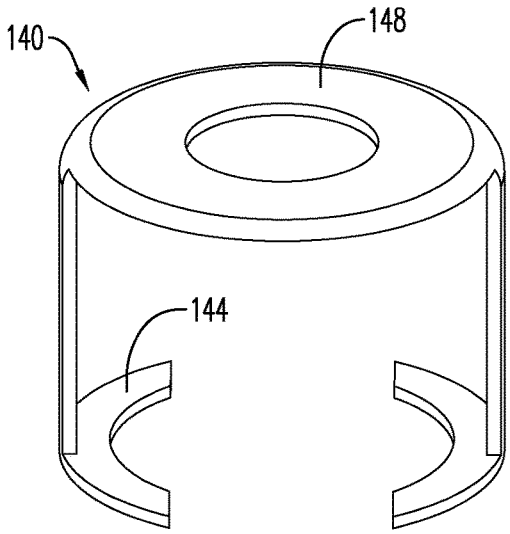
FIG. 16A shows an external clip assembly, according to an exemplary embodiment.
Figure 16B:
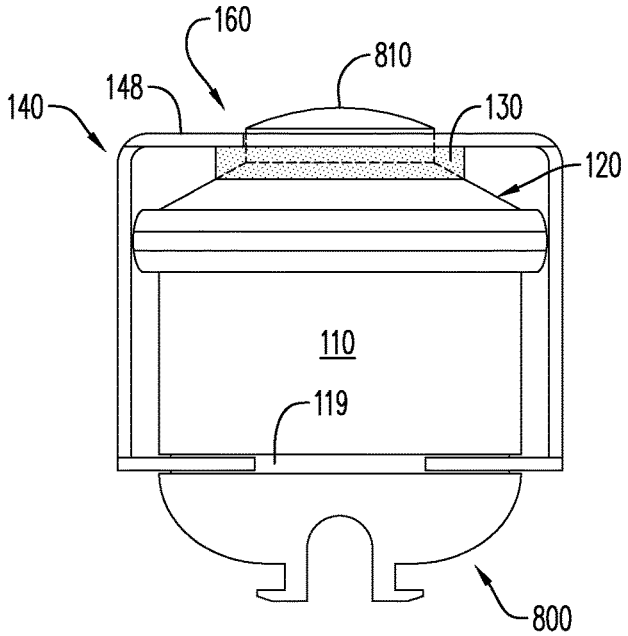
FIG. 16B shows an encapsulated conical shaped charge, according to an exemplary embodiment.
Figure 17A:
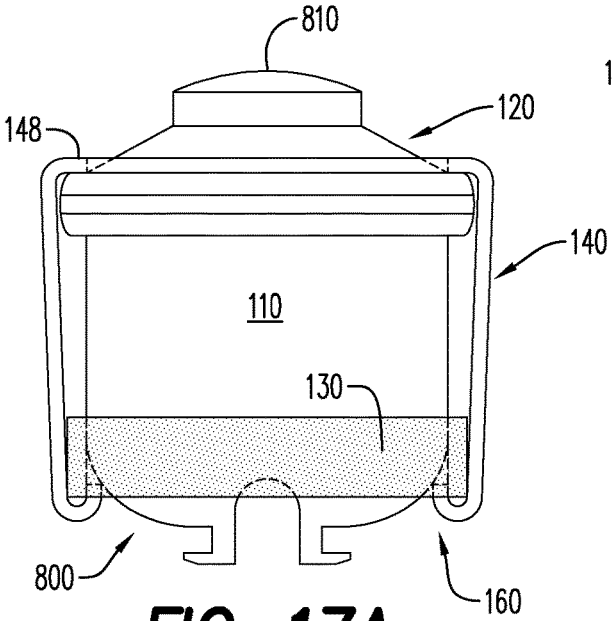
FIG. 17A shows an encapsulated conical shaped charge, according to an exemplary embodiment.
Figure 17B:
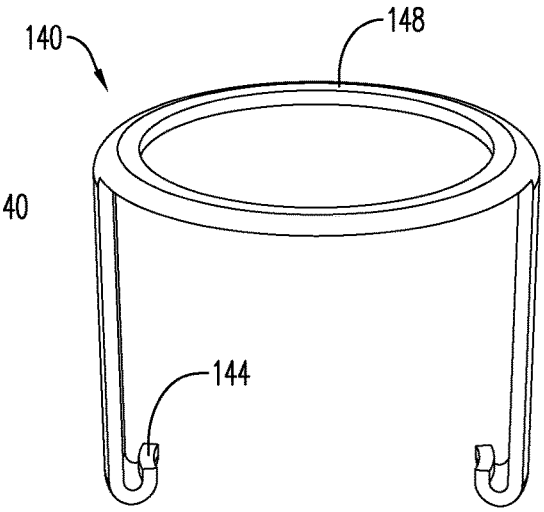
FIG. 17B shows an external clip assembly, according to an exemplary embodiment.
Figure 18A:
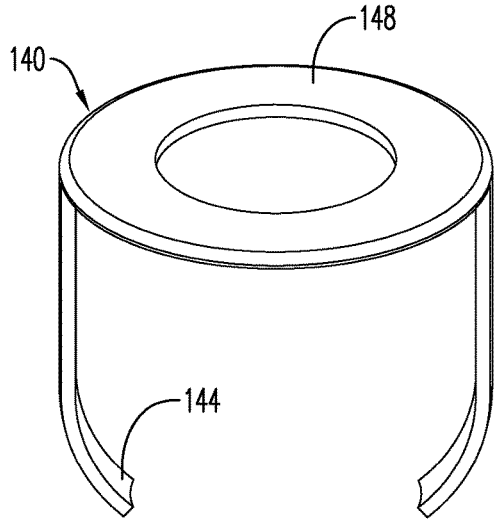
FIG. 18A shows an external clip assembly, according to an exemplary embodiment.
Figure 18B:
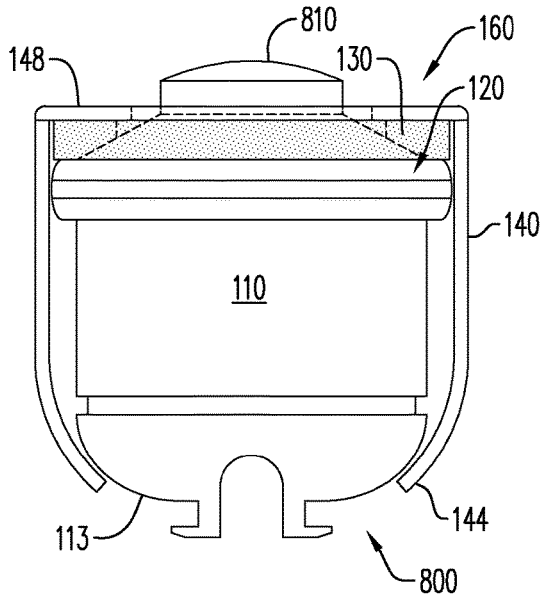
FIG. 18B shows an encapsulated conical shaped charge, according to an exemplary embodiment.
Figure 19A:
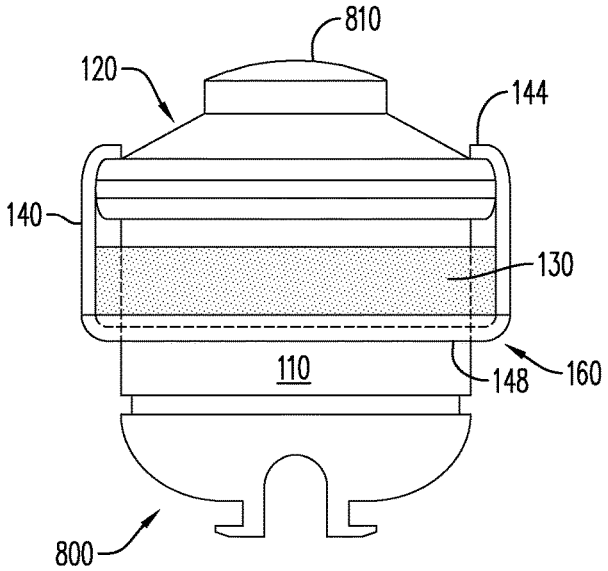
FIG. 19A shows an encapsulated conical shaped charge, according to an exemplary embodiment.
Figure 19B:
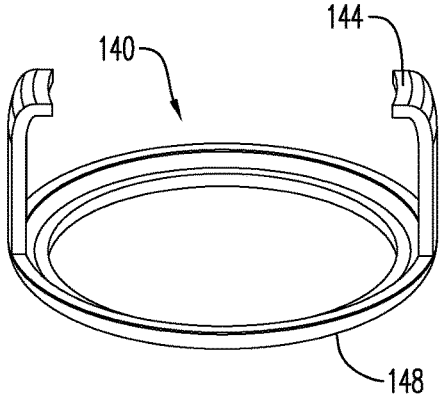
FIG. 19B shows an external clip assembly, according to an exemplary embodiment.

With additional reference to FIGS. 7 and 14, each clip 140 includes an inward bend forming a hook end 145 at a top (or, first) end of the clip 140, and a wave-shaped end 143 at a bottom (or, second) end of the clip 140. At the wave-shaped end 143, the clip 140 bends inward and includes a pocket 143*a* with a contour that is concave relative to a bottom surface 115 of the charge case 110 and extends to form a bulge 143*b* that is adjacent to the pocket 143*a* and convex relative to the bottom surface 115 of the charge case 110. The clip 140 fastens the charge lid 120 to the charge case 110. For example, the hook end 145 receives the retainer ring 130 within a groove 149 defined by the hook end 145, and the retainer ring 130 includes a cutout area 132 for accommodating a portion of the hook end 145 that is positioned between the charge lid 120 and the retainer ring 130, at a top connecting area 141 of the encapsulated shaped charge 100. The bulge 143*b* of the wave-shaped end 143 is dimensioned to fit within a track 118 formed in the bottom surface 115 of the charge case 110, at a bottom connecting area 142 of the encapsulated shaped charge 100 (FIG. 5). With additional reference to FIG. 15, the pocket 143*a* is dimensioned for accommodating an edge 118*a* of the charge case 110 when the clip 140 is attached thereto. The edge 118*a* may form one side of the track 118.

The clip 140 may be formed from a resilient material including a metal, plastic, or stiff elastomer, and dimensioned such that a resilient force of the clip 140 pulls the hook end 145 and the wave-shaped end 143 towards each other, after the clip 140 has been positioned on the encapsulated shaped charge 100. In an aspect, and with particular reference to FIGS. 3 and 5, each clip 140 is positioned on a respective face wall 110*a*, i.e., extending along at least a portion of the respective face wall 110*a*, on the exterior of the charge case 110. Each clip 140 is connected at the top, i.e., hook end 145, to the retainer ring 130 and thereby the charge lid 120. Each clip 140 extends from the hook end 145 to the bottom, i.e., wave-shaped end 143, and is connected at the wave-shaped end 143 to the bottom surface 115 of the charge case 110. The resilient force thereby fastens the charge lid 120 to the charge case 110, in normal operation.

The retainer ring 130 may be made of, for example and without limitation, plastic or other resilient material consistent with this disclosure. In the exemplary embodiments as shown in FIGS. 2B, 3, 8, and 13, the retainer ring 130 includes at least one beveled edge 131. The beveled edge 131 may help to facilitate an enhanced fit between the charge lid 120 and the charge case 110. For example, the beveled edge 131 of the retainer ring 130 may provide more surface area than, in contrast, orthogonal sides against which the hook end 145 may engage and exert a force towards the charge case 110. As seen, for instance, in FIG. 2B, it is contemplated that the charge case 110 and the charge lid 120 may also include beveled edges 133, 134. The respective beveled edges 133, 134 on the charge lid 120 and the charge case 110 may help to reduce the overall diameter of the encapsulated shaped charge 100 so that the encapsulated shaped charge 100 can fit into wellbore casings having smaller or reduced inner diameters.

If the encapsulated shaped charge 100 experiences, e.g., high temperatures, the retainer ring 130 is configured to melt or burn and thereby release each clip 140 that is supported on the retainer ring 130. Thus, the clips 140 will disengage from the encapsulated shaped charge 100, and the charge lid 120 will no longer be held to the charge case 110. Gas pressure within the charge case 110 may then vent through a separation between the charge lid 120 and the charge case 110, and the venting may prevent a potentially damaging buildup of pressure within the charge case 110.

Figure 12:
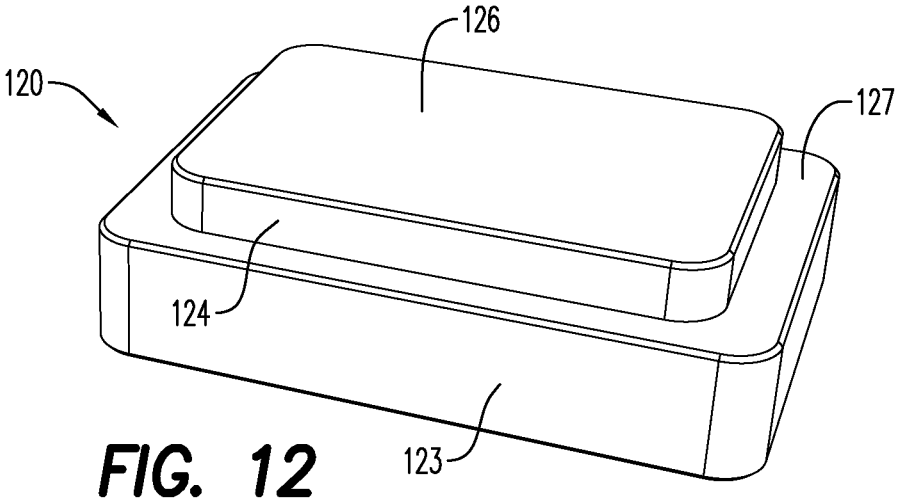
FIG. 12 is an enlarged view of the charge lid of FIG. 9, according to an exemplary embodiment.
Figure 13:
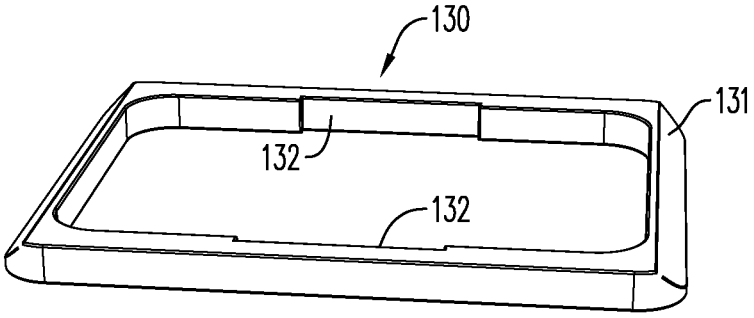
FIG. 13 is an enlarged view of the retainer ring shown in FIG. 8, according to an exemplary embodiment.

With reference now to FIGS. 9 and 12, the charge lid 120 includes a body portion 123, a neck portion 124, and a top lid surface 126. In an aspect, and with additional reference to FIGS. 1, 4, and 10A-10B, the body portion 123 includes an outer lip 125*a* and an inner lip 125*b* extending downwardly from the inside portion 122 of the charge lid 120. The outer lip 125*a* is positioned along a periphery of the body portion 123 and the inner lip 125*b* is spaced apart from the outer lip 125*a*. The channel 125 for receiving the o-ring 150 is defined between the inner lip 125*b* and the outer lip 125*a*. The body portion 123 is dimensioned for the inner lip 125*b*, the outer lip 125*a*, and the channel 125 (and the o-ring 150, when inserted) to extend substantially contiguously with an upper surface 170 of the charge case 110, when the charge lid 120 is positioned on the charge case 110. For purposes of this disclosure, "substantially contiguously" and other terms of relative measure are used to aid in understanding the exemplary embodiments according to the features, functions, and relationships of components but without limitation thereto. For example, as shown in FIG. 1, the outer lip 125*a*, the channel 125, and the inner lip 125*b* are positioned next to or share a border with the upper surface 170 of the charge case 110, to form a sealable closure between the charge case 110 and the charge lid 120.

Figure 10B:
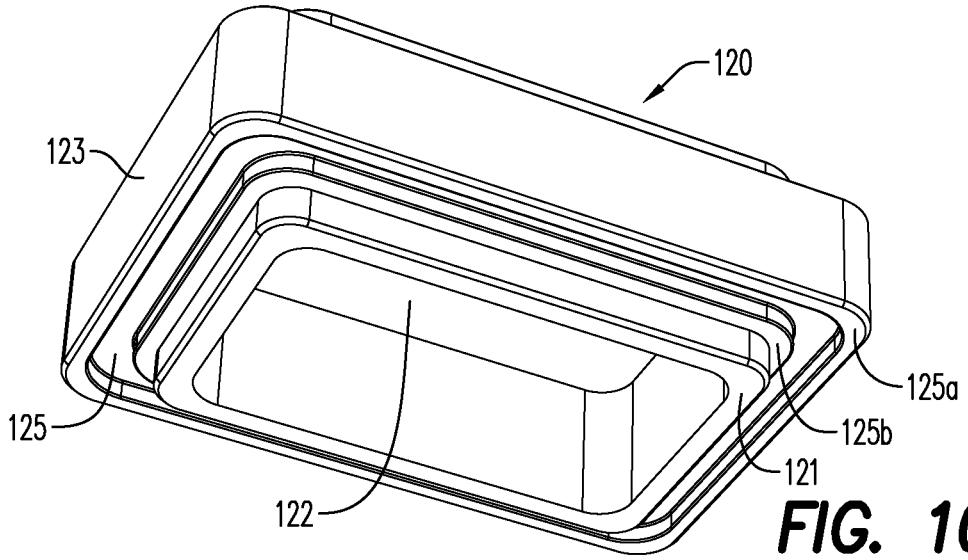
FIG. 10B is an enlarged view of the charge lid of FIG. 10A, according to an exemplary embodiment.

With particular reference to FIGS. 1 and 10B, the inner skirt 121 extends downwardly from the inside portion 122 of the charge lid 120 to a position below the inner lip 125*b*. The inner skirt 121 is dimensioned to extend contiguously along a portion of an inner surface 175 of the charge chase 110 within the case interior 116.

With reference back to FIGS. 9 and 12, the body portion 123 includes a top surface defining the shoulder 127, which is bound on an inside by the neck portion 124. The shoulder 127 is, in the exemplary embodiments but without limitation thereto, a substantially planar surface. For example, the shoulder 127 is configured for receiving the retainer ring 130 thereon. The neck portion 124 extends generally upwardly from the shoulder portion 127. The top lid surface 126 is positioned above the neck portion 124. In an aspect, the neck portion 124 may extend inwardly, transitioning to the charge lid beveled edge 133 and then the top lid surface 126. While the various charge lid portions 123, 124, 126, 133 are identified to aid in understanding the exemplary embodiments, they are not limited to any particular boundaries, configurations, geometries, delineations, dimensions, etc. of the charge lid 120.

FIGS. 16A-19B show exemplary embodiments of a fastening assembly 160 configured for holding components of an encapsulated conical shaped charge 800 together. The encapsulated conical shaped charge 800 includes, as previously discussed, a charge lid 120 and a charge case 110, albeit having a generally circular geometry. In each of the exemplary embodiments, the fastening assembly 160 includes an external clip assembly 140 and a retainer ring 130 as previously discussed. However, the exemplary embodiments of an external clip assembly 140 as shown in FIGS. 16A-19B include an annular end 148 configured for slipping over a head portion 810 of the charge lid 120, or around the charge case 110, to prevent the clips 140 from falling off and disengaging the charge lid 120 from the charge case 110. A connection end 144 opposite the annular end 148 includes a contour or configuration that allows the connection end 144 to couple with, for example, a groove 119 in the charge case 110, the retainer ring 130, a rounded bottom 113 of the charge case 110, or the charge lid 120. As previously discussed, the retainer ring 130 may be configured to melt or burn upon exposure to fire. In response to the retainer ring 130 melting or burning, at least one of the charge case 110, the charge lid 120, and the clip 140 may have a degree of movement through the space previously occupied by the retainer ring 130, thereby allowing the charge lid 120 to separate from the charge case 110 at least sufficiently to vent any gas pressure that has built up within the charge case 110. In these or other embodiments, the clip 140 may be configured to melt or burn upon exposure to fire, such that the charge lid 120 and the charge case 110 are no longer fastened. In such embodiments the retainer ring 130 may be made from a resilient material that provides a fastening structure for the clip 140 and a compression against, e.g., the charge case 110 or charge lid 120, which may strengthen the coupling therebetween.

FIG. 20 shows an exemplary exposed perforating gun system 200 including a charge carrier 210 that retains and orients encapsulated shaped charges 100. In FIG. 20, the encapsulated shaped charges are encapsulated slotted shaped charges 100 according to the exemplary embodiments discussed throughout this disclosure.

In an aspect, the disclosure relates to a method for reducing a buildup of gas pressure in an encapsulated shaped charge exposed to fire. With reference to the exemplary embodiments of an encapsulated shaped charge 100, 800 as discussed throughout this disclosure, the method may include providing the encapsulated shaped charge 100, 800 with a charge case 110 holding an explosive 111 and a liner 112, a charge lid 120 covering an open end 117 of the charge case 110, and a fastening assembly 160 connected to each of the charge case 110 and the charge lid 120. The fastening assembly 160 may include a retainer ring 130 and an external clip assembly 140. The retainer ring 130 and/or the external clip assembly 140 may be configured to melt or burn and thereby release the external clip assembly 140, when the encapsulated shaped charge 100, 800 is exposed to fire.

More specifically, an exemplary embodiment of a method for reducing a buildup of gas pressure in an encapsulated shaped charge 100, 800 exposed to fire includes enclosing an explosive 111 within a charge case 110 and positioning a charge lid 120 on an open end 117 of the charge case 110 within which the explosive 111 is contained. The method may further include releasably connecting the charge lid 120 to the charge case 110. For example, releasably connecting the charge lid 120 to the charge case 110 may include positioning a retainer ring 130 on the charge lid 120, connecting a first end (e.g., hook end 145) of the external clip assembly 140 to the retainer ring 130, and connecting a second end (e.g. wave-shaped end 143) of the external clip assembly 140 to a bottom 113 or a bottom surface 115 of the charge case 110. In an aspect, the retainer ring 130 is configured to melt or burn in response to exposure to fire. The method may further include releasing the external clip assembly 140 from the charge lid 120 and/or encapsulated shaped charge 100, 800, in response to the retainer ring 130 melting or burning. In response to the external clip assembly 140 being released from the charge lid 120 and/or encapsulated shaped charge 100, 800, the charge lid 120 is separable from the charge case 110 at least sufficiently to release gas pressure that has built up within the charge case 110.

In an aspect of the exemplary method, the external clip assembly 140 may extend from the bottom 113 or the bottom surface 115 of the charge case 110 to the retainer ring 130 positioned on the charge lid 120. The external clip assembly 140 may be formed from a resilient material.

With reference now to FIGS. 21-26, a further exemplary embodiment of an encapsulated shaped charge 100 is shown. The encapsulated shaped charge 100 shown in FIGS. 21-26 is configured substantially according to the exemplary embodiments shown and described above with respect to FIGS. 1-15, except where otherwise noted and/or not inconsistent therewith. Accordingly, common aspects may not necessarily be repeated but form part of the disclosure of the exemplary embodiments shown in FIGS. 21-26, to the extent they are not inconsistent.

For example, the exemplary embodiments shown in FIGS. 21-26 include a charge case 110 and a charge lid 120, and the charge lid 120 includes an inner skirt 121 extending downwardly from an inside portion 122 of the charge lid 120. In an aspect, the charge lid 120 further includes an angled section 310 on each side of the charge lid 120 corresponding to the face walls 110*a* of the charge case 110. The encapsulated shaped charge 100 further includes an external clip assembly including opposing clips 140 each connected at a hook end 145 to a retainer ring 130 positioned on the charge lid 120. Each clip 140 is positioned next to a respective angled section 310. In the event that the retainer ring 130 melts or burns, the hook end 145 of the clip 140 may easily slip along the angled section 310, to release the charge lid 120.

Figure 23:
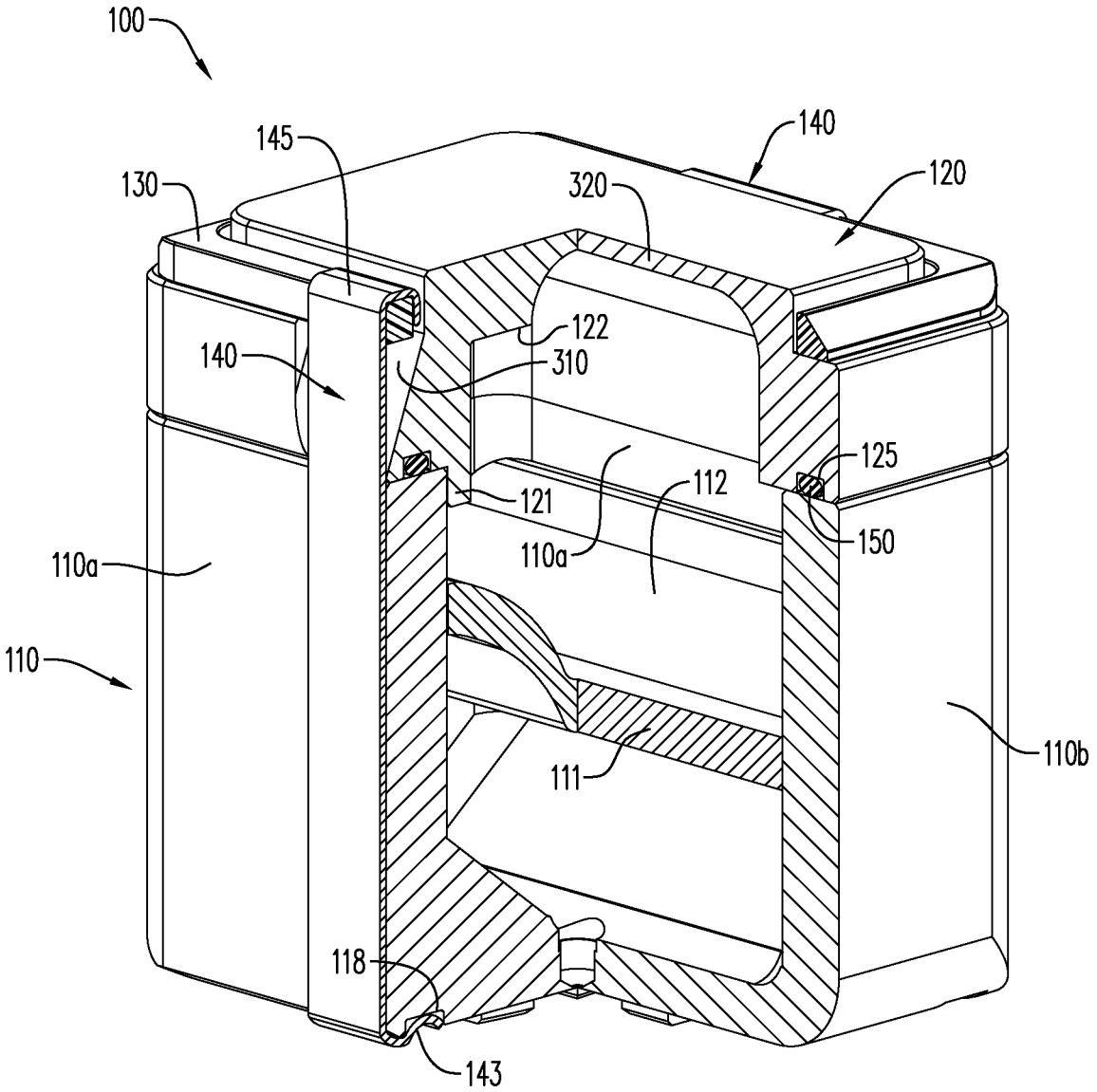
FIG. 23 is a partial cross-sectional view of an encapsulated shaped charge, according to an exemplary embodiment.
Figure 24:
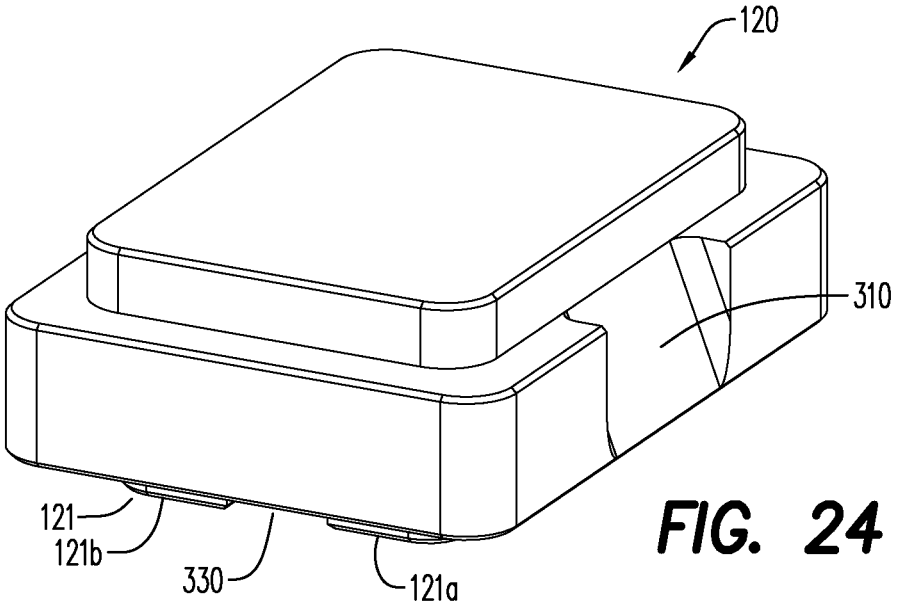
FIG. 24 is a front, top perspective view of a charge lid, according to an exemplary embodiment.
Figure 25:
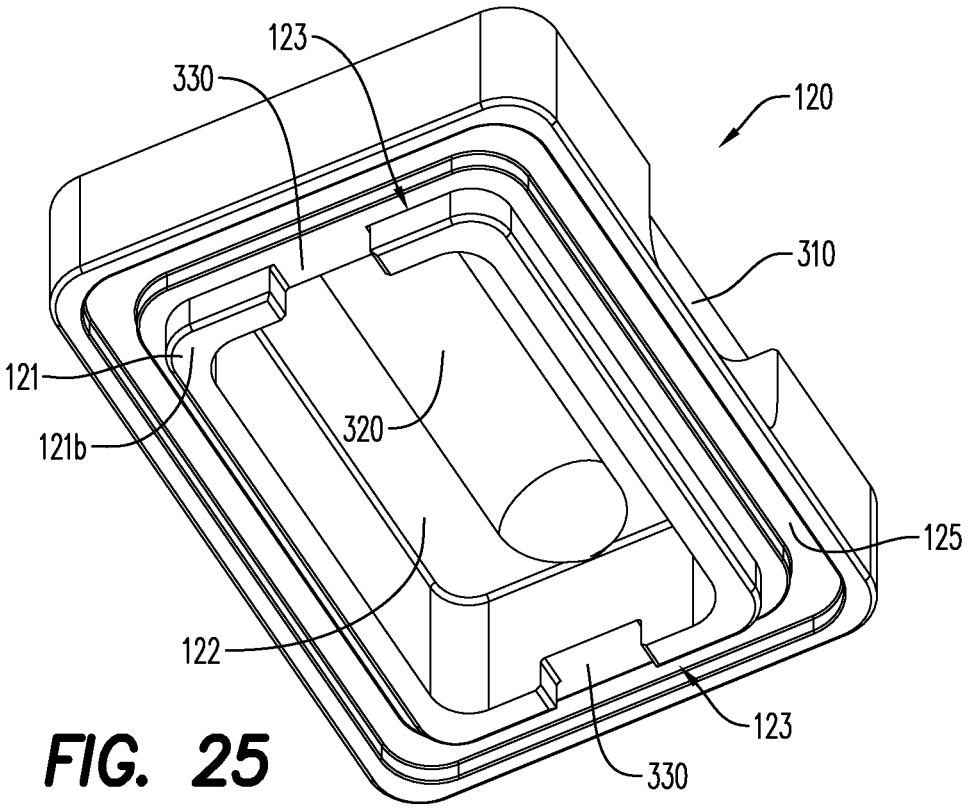
FIG. 25 is a bottom perspective view of a charge lid, according to an exemplary embodiment.
Figure 26:
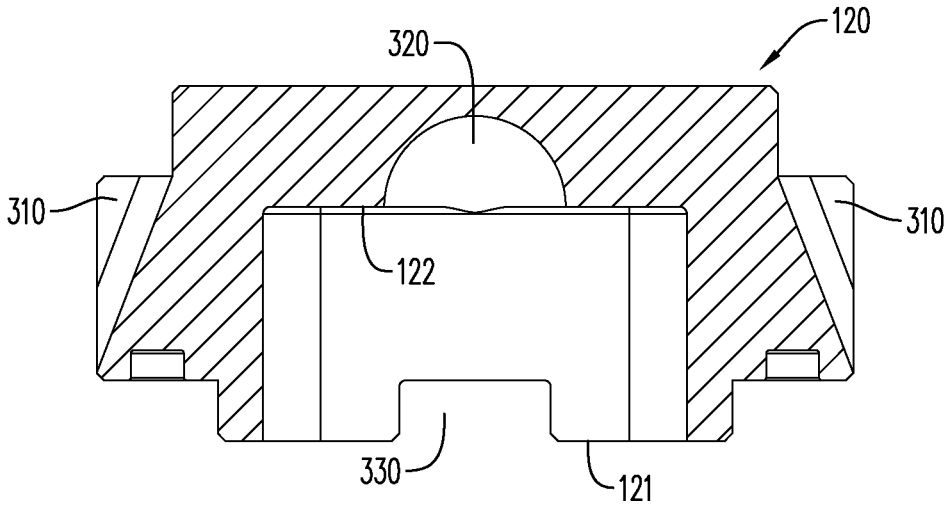
FIG. 26 is a cross-sectional view of a charge lid, according to an exemplary embodiment.

In a further aspect and as illustrated in FIG. 23, FIG. 25 and FIG. 26, the inside portion 122 of the charge lid 120 includes a weakened zone 320 defined by a reduced local thickness of the charge lid 120. In an aspect, the weakened zone 320 is formed in a dome-like shape. The exemplary configuration may contribute to the ballistic performance of the encapsulated shaped charge 100 while not sacrificing the pressure rating. For example, the weakened zone 320 may contribute to maintaining or maximizing the cutting force of a perforating jet passing through the charge lid 120 to sever control lines behind a wellbore casing, in a representative application.

In a further aspect, the inner skirt 121 includes a gap 330 on short sides 123 of the inner skirt 121 corresponding to the side walls 110*b* of the charge case 110. The gap 330 may allow gasses to escape from within the charge case 110 in the event of a fire exposure. The gap 330 is formed, e.g., as a void between a first skirt portion 121*a* and a second skirt portion 121*b*.

In an aspect of the exemplary embodiments, the external clip assembly including one or both of the opposing clips 140 is bendable and resiliently connects to each of the charge case 110 and the charge lid 120. The one or both of the opposing clips 140 may be formed from a bendable steel or metal. The configuration and features of the external clip assembly, i.e., a bendable, resiliently connectable clip that extends vertically from the charge case 110 to the charge lid 120 on an outside of the encapsulated shaped charge 110, may avoid the need to crimp a charge lid to a charge case to form an encapsulated shaped charge. Accordingly, the exemplary configuration may avoid the need to crimp a charge lid to a charge case, which may avoid potential safety and operational issues created by, e.g., accidental deformation of seal surfaces.

Further, removing the need to crimp the charge lid to the charge case may provide an easier manufacturing method with cost savings and greater efficiency. For example, when crimping is used, non-axisymmetrically shaped encapsulated charges may require custom planning for individual designs.

In addition, the outside position of the external clip assembly allows the retainer ring 130 to be similarly positioned on the outside of the encapsulated shaped charge 100, thereby exposing the retainer ring 130 directly to flame/heat that may trigger melting or burning of the retainer ring 130. This may provide greater safety over, e.g., encapsulated shaped charges in which a melt ring is positioned within the metal of a charge lid or charge case, and therefore requires additional time to melt as the metal heats up.

In an aspect of the exemplary embodiments and as illustrated in FIGS. 23 and 25, for example, the seal, i.e., o-ring 150, is positioned on the charge lid 120 within the channel 125 formed in the inside portion 122 of the charge lid 120. The exemplary configuration may avoid issues created by, e.g., placing a seal on the charge case near the explosives contained therein, which may affect the integrity of the seal, and/or safety and ballistic performance of the encapsulated shaped charge if, e.g., explosives are accidentally deposited on the o-ring or within a groove in which the o-ring is positioned. Further, the exemplary configuration of the o-ring 150 within the channel 125 on the inside portion 122 of the charge lid 120 removes the o-ring 150 from venting passage(s) and, accordingly, the o-ring 150 need not participate in the venting process.

In an aspect of the exemplary embodiments, the retainer ring 130 is made from a polyamide, for example PA6.

Embodiments described herein relate generally to devices, systems, and methods for an encapsulated shaped charge for an exposed perforating gun system, and associated systems and methods. For purposes of this disclosure, the phrases "devices," "systems," and "methods" may be used either individually or in any combination referring without limitation to disclosed components, grouping, arrangements, steps, functions, or processes.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. An encapsulated shaped charge, comprising:

a charge case holding an explosive and a liner;

a charge lid covering an open end of the charge case; and an external clip assembly connected to each of the charge case and the charge lid;

wherein the charge lid includes an inner skirt extending downwardly from an inside portion of the charge lid; and the inner skirt includes a gap.

2. The encapsulated shaped charge of claim 1, wherein the external clip assembly includes a first clip on a first face wall of the charge case and a second clip on a second face wall opposite the first face wall of the charge case, wherein the first clip and the second clip are each connected to a retainer ring positioned on the charge lid.

3. The encapsulated shaped charge of claim 2, wherein the retainer ring is formed from a plastic.

4. The encapsulated shaped charge of claim 2, wherein the retainer ring is made from a polyamide.

5. The encapsulated shaped charge of claim 4, wherein the polyamide is PA6.

6. The encapsulated shaped charge of claim 2, wherein the retainer ring is configured to melt or burn, and release one or both of the first clip and the second clip, in response to the encapsulated shaped charge being exposed to fire.

7. The encapsulated shaped charge of claim 1, wherein the charge lid includes an angled section, the external clip assembly includes a clip, and the clip is positioned next to the angled section.

8. The encapsulated shaped charge of claim 1, wherein the charge lid includes a weakened zone defined by a reduced local thickness on an inside portion of the charge lid.

9. The encapsulated shaped charge of claim 8, wherein the weakened zone is dome shaped.

10. The encapsulated shaped charge of claim 1, wherein the gap is formed as a void between a first skirt portion and a second skirt portion.

11. The encapsulated shaped charge of claim 1, wherein the external clip assembly includes a clip configured to melt or burn in response to the encapsulated shaped charge being exposed to fire.

12. The encapsulated shaped charge of claim 1, wherein the external clip assembly includes a clip, wherein the clip is bendable and resiliently connects to each of the charge case and the charge lid.

13. The encapsulated shaped charge of claim 12, wherein the clip is formed from a bendable steel or metal.

14. The encapsulated shaped charge of claim 1, further comprising a seal positioned on the charge lid.

15. The encapsulated shaped charge of claim 14, wherein the seal is an o-ring positioned in a channel formed in the charge lid.

16. An exposed perforating gun system, comprising:

a charge carrier retaining a plurality of encapsulated shaped charges, wherein each encapsulated shaped charge includes:

a charge case holding an explosive and a liner, a charge lid covering an open end of the charge case, and an external clip assembly connected to each of the charge case and the charge lid;

wherein the charge lid includes an inner skirt extending downwardly from an inside portion of the charge lid; and the inner skirt includes a gap.

17. A method for reducing a buildup of gas pressure in an encapsulated shaped charge exposed to fire, comprising:

enclosing an explosive within a charge case, wherein the step of enclosing the explosive includes positioning a charge lid on an open end of the charge case within which the explosive is contained;

releasably connecting the charge lid to the charge case, wherein releasably connecting the charge lid to the charge case includes positioning a retainer ring on the charge lid, and connecting a first end of a clip to the retainer ring and a second end of the clip to a bottom surface of the charge case, wherein the retainer ring is configured to melt or burn in response to exposure to fire; and releasing the clip from the retainer ring, in response to the retainer ring melting or burning in response to exposure to fire.

18. The method of claim 17, wherein the clip extends from the bottom surface of the charge case to the retainer ring on the charge lid, and the clip is formed from a resilient material.

* * * * *